US006368089B1

(12) United States Patent
Frolík

(10) Patent No.: US 6,368,089 B1
(45) Date of Patent: Apr. 9, 2002

(54) ORBITING BLADE ROTARY MACHINE

(76) Inventor: Jiří Frolík, Makovského 1340, CZ - 163 00, Praha 6, CZ 163 00 (CZ)

( * ) Notice: Subject to any disclaimer, the term of this patent is extended or adjusted under 35 U.S.C. 154(b) by 0 days.

(21) Appl. No.: 09/564,812

(22) Filed: May 4, 2000

(51) Int. Cl.[7] ..... F01C 1/352; F01C 19/00
(52) U.S. Cl. ..... 418/92; 418/138; 418/141
(58) Field of Search ..... 418/92, 137, 138, 418/141, 241

(56) References Cited

U.S. PATENT DOCUMENTS

| | | | | | |
|---|---|---|---|---|---|
| 785,288 | A | * | 3/1905 | Bruckert | 418/138 |
| 993,053 | A | * | 5/1911 | Goehst et al. | 418/138 |
| 1,140,983 | A | * | 5/1915 | Hye et al. | 418/241 |
| 1,270,522 | A | * | 6/1918 | Jacobsen | 418/138 |
| 1,667,456 | A | * | 4/1928 | Cozette | 418/241 |
| 2,049,794 | A | * | 8/1936 | Armor | 418/241 |
| 2,071,258 | A | * | 2/1937 | Haydock, Jr. et al. | 418/138 |
| 3,073,118 | A | * | 1/1963 | August | 418/241 |
| 4,024,840 | A | * | 5/1977 | Christy | 418/138 |
| 5,332,375 | A | * | 7/1994 | Kuechler | 418/138 |
| 5,489,199 | A | * | 2/1996 | Palmer | 418/241 |

FOREIGN PATENT DOCUMENTS

| | | | | |
|---|---|---|---|---|
| JP | 57-76206 | * | 5/1982 | 418/141 |
| JP | 58-70087 | * | 4/1983 | 418/138 |

* cited by examiner

*Primary Examiner*—John J. Vrablik
(74) *Attorney, Agent, or Firm*—Peter R. Ruzek

(57) ABSTRACT

An orbiting blade rotary machine, especially for use in compressor and expansion motor units, includes a stator housing bounding an internal space that includes a substantially cylindrical internal chamber centered on a central axis. A power shaft extends in a centered relationship along the central axis through the internal space, being mounted on the stator housing for rotation about the central axis. Each of a plurality of orbiting blades extends substantially radially outwardly from the power shaft in the internal chamber toward the stator housing in its neutral position, being supported on the power shaft for pivoting within a limited angular range around the neutral position. An eccentric rotor is mounted in the stator housing for rotation about an eccentric axis parallel to and transversely offset from the central axis, being accommodated in the internal chamber to delimit a working space that the orbiting blades subdivide into individual compartments. Cylindrical guide members received between stationary connecting bars guide the orbiting blades within their axially and radially extending passages for sliding relative to the eccentric rotor while performing the limited pivoting relative to the power shaft. The auxiliary gear train includes a crown gear rigid with the eccentric rotor, an auxiliary shaft mounted in the housing for rotation about an axis parallel to and transversely offset from the central axis, a first and a second auxiliary spur gear secured to the auxiliary shaft for joint rotation therewith, the first auxiliary spur gear being in permanent meshing relationship with the crown gear, and another spur gear secured to the power shaft for joint rotation therewith and permanently meshing with the second auxiliary spur gear. A labyrinth seal may be provided at least on a marginal portion of each of the orbiting blades that is remote from the power shaft to seal the corresponding interface, and a pressurized sealing fluid may be supplied to it through channels present in the respective blade.

4 Claims, 7 Drawing Sheets

ORBITING BLADE ROTARY MACHINE

BACKGROUND OF THE INVENTION

1. Field of the Invention

The present invention relates to pressure fluid machines of the rotary kind in general, and more particularly to machines of this type that incorporate orbiting blades.

2. Description of the Related Art

There are already known various constructions of machines that will be collectively referred to herein as pressure fluid machines, that is machines that either compress or pump gases or liquids (generally referred to herein as pumps), or are powered either by pressurized or by expanding, combusting, exploding or otherwise chemically reacting fluids (generally referred to herein as engines). The term "pumps" as used here includes those machines that compress or otherwise impart potential or kinetic energy to fluids, be they compressors, blowers or actual pumps, while the term "engines" stands not only for those of the steam or internal combustion varieties but also for other fluid-powered machines that are ordinarily called motors or drives. Among the heretofore proposed pressure fluid machines, there are also those of the rotary type, that is those including rotors mounted for rotation in respective internal chambers of associated stators or housings.

Some rotors of such rotary engines or pumps include blades that orbit associated axes within the respective internal chambers, being ordinarily in frictional contact at their outer peripheral end faces with the surfaces bounding such chambers. Typically, in a machine of this type, the aforementioned axis is that of the internal chamber and also of a torque-transmitting (i.e. input or output, as the case may be) shaft traversing such chamber, and the rotor includes, besides the blades, a body that is mounted on the housing for eccentric turning or rotational movement about and relative to this axis or shaft and serves as a carrier or entrainment member for the blades. A known representative of this approach is to be found in the publication *Grundzüge der Theorie und des Baues der Dampfturbinen mit der Berücksichtigung der Rotationsdmapfmaschinen,* by Peter Stierstorfer, Leipzig, Germany (1904), in which page 139 reveals a so-called "Patschke" rotary steam engine. Its structure is characterized in that one of its blades is rigidly connected with the central shaft which thus becomes torque-transmitting in that the torque imparted to it by the one blade is transmitted thereby to the exterior of the engine and ultimately to a part or parts driven by this torque. In the course of the rotation of the rotor, the orbiting blade is retracted into or extended out of an associated opening provided for it in the entraining rotor member or body; this has for its consequence alternating changes in the working radius of this orbiting blade and simultaneously the latter is accelerated and subsequently decelerated during each rotation, depending on the angular position about the central axis at which it is situated at any particular time. Simultaneously with and as a direct consequence of the increase and decrease in the circumferential speed of the orbiting blade, even the speed of the torque-transmitting shaft varies accordingly in the course of the respective revolution, owing to the rigid connection of the one orbiting blade with the shaft. This causes non-uniform rotation and pulsation of this shaft. When the torque-transmitting shaft is subsequently subjected to an additional torque of, for instance, a drive machine and/or a driven wheel of a mobile machine, and/or by a simple increase in the energy level of the supplied medium in an expansion motor, or during the transmission of high compression ratios of the fluid media being pressurized in compressors, there is encountered an excessively high stressing at the region of the rigid connection between the orbiting blade and the torque-transmitting shaft. This disadvantageous repetitive stressing results in relatively high incidence of damage to the machine, reduces its useful life, and requires the performance of an arduous process in the selection of suitable materials.

Another known implementation of a rotary machine with orbiting blades involves loose accommodation of such blades in radial recesses formed at the outer periphery of the eccentrically mounted rotor body. This solution exhibits a plethora of disadvantages stemming basically from the fact that the centrifugal forces acting on the individual blades increase with increasing rotational speed of the rotor. As a result, the force with which each of them presses against the surface circumferentially bounding the internal chamber of the stator increases as well, and the frictional losses of the pressure fluid machine increase disproportionately. Then, there exists a limit on the rotational speed of the rotor for the machine to be able to perform its function, and when this limit is exceeded, the encountered friction forces consume all of the input energy and the machine rotor rotation is retarded up to the point of ceasing altogether. A further disadvantage of this solution is to be seen in the fact that there is merely a line contact between the outer peripheral surface of the respective orbiting blade and its counterpart on the stator, inasmuch as the orbiting blades are centered not on the central axis of the cylindrical working space or chamber of the stator, but rather on the axis of the eccentrically mounted rotor that is transversely offset from the central axis; this limits the use of the machine of this construction to just as a compressor.

Another technical solution that has a pronounced bearing on the present invention is disclosed in the European patent EP 0 102 555. This machine includes a hollow cylindrical stator housing in the interior of which there is eccentrically mounted a rotor body; the latter has mounted thereon, at its outer periphery, respective cylindrical guiding members for free turning relative to the rotor body about respective axes extending parallel to the central axis of the internal chamber of the chamber. A pivot axle centered on this axis is immovable relative to the stator housing. Orbiting blades pass through the respective guiding members to cooperate with the inner surface of the cylindrical stator housing. These blades extend substantially radially with respect to the central pivot axle, and their radial distance is adjustable by means of connecting rods that are rotatably supported on the central pivot axle.

Disadvantages of this solution are to be seen primarily in the existence of tilting moments arising as a consequence of asymmetrical support of the connecting rods on the central pivot axle, and in their implementation with an adjustable feature, which involves technical complexity and, in the event of thermal loading, low resistance to deformations. Another persisting drawback exists at the sealing locations, which are problematical especially at the interfaces between the orbiting blades and the rotor body, and between the outer peripheral surfaces of the blades and the inner surface bounding the internal chamber of the cylindrical stator housing. It is also necessary to offset the axial termination of the rotating part or rotor body from the corresponding portion of the stator housing facing the same, and a high gradient of the pressure medium exists at this region, with attendant high losses of such medium. Last but not least, the cantilevered mounting of the central pivot axle detracts from the mechanical stability of the machine.

Generally applicable disadvantages of the heretofore known rotary machine systems with orbiting blades include the existence of considerable frictional forces both between the orbiting blades and the rotor body and between the orbiting blades and the stator housing, as well as the existence of high material stresses at the connection locations of the orbiting blades and the torque-transmitting shaft. When the orbiting blades are loosely supported on the rotor body, frictional forces that are significantly increased with increasing speed of rotation are encountered even at the contact surface of the orbiting blade at its outer periphery with the surface bounding the internal chamber of the stator housing. In view of these drawbacks, the heretofore presented embodiments of these machines have been limited to rotary machines with a relatively large axial length of the rotor part accompanied by a relatively small diameter thereof, in which the frictional forces encountered are not yet too destructive, and in which there exists a better possibility of sealing the zones between the axial end faces of the rotating part and the corresponding surfaces of the stator part, especially in air expansion motors and air compressors, such as in the Wittig systems.

OBJECTS OF THE INVENTION

Accordingly, it is a general object of the present invention to avoid the disadvantages of the prior art.

More particularly, it is an object of the present invention to provide a rotary machine that does not possess the drawbacks of the known of this type.

Still another object of the present invention is to devise a rotary machine of the type here under consideration in which power and speed pulsations encountered in similar conventional machines are kept to a minimum if not eliminated altogether.

It is yet another object of the present invention to design the above rotary machine in such a manner as to minimize frictional and other losses to enable its operation at extremely high throughput rates.

A concomitant object of the present invention is so to construct the of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an orbiting blade rotary machine, especially for use in compressor and expansion motor units, which includes a stator housing bounding an internal space that includes a substantially cylindrical internal chamber centered on a central axis. A power shaft extends in a centered relationship along the central axis through the internal space inclusive of its working chamber and is mounted on the stator housing for rotation about the central axis. Each of a plurality of orbiting blades extends substantially radially outwardly from the power shaft in the internal chamber toward the stator housing in a neutral position thereof and is supported for pivoting within a limited angular range around the neutral position relative to the power shaft. An eccentric rotor is mounted in the stator housing for rotation about an eccentric axis parallel to and transversely offset from the central axis and is accommodated in the internal chamber to delimit in it a working space that the orbiting blades subdivide into individual compartments. The eccentric rotor includes means for guiding the orbiting blades for sliding relative to the eccentric rotor while performing the limited pivoting relative to the power shaft. In accordance with the invention, there is further provided means for positively transmitting torque between the eccentric rotor and the power shaft; and means for sealing the interfaces between the orbiting blades and the stator housing.

The torque transmitting means advantageously includes at least one torque transmitting gear train including a crown gear rigid with the eccentric rotor, an auxiliary shaft mounted in the housing for rotation about an axis parallel to and transversely offset from the central axis, a first and a second auxiliary spur gear secured to the auxiliary shaft for joint rotation therewith, the first auxiliary spur gear being in permanent meshing relationship with the crown gear, and another spur gear secured to the power shaft for joint rotation therewith and permanently meshing with the second auxiliary spur gear. It is also advantageous when the eccentric rotor includes a pair of axially spaced carrier rings and a plurality of connecting bars interconnecting the carrier rings in substantial parallelism with the eccentric axis and including substantially part-circular cylindrical surfaces facing each other. Then, the guiding means advantageously includes a plurality of guiding cylinders, one for each of the orbiting blades, each accommodated in sealed relationship between the surfaces of the connecting bars for turning relative thereto and each including an axially and radially extending passage for receiving the respective one of the orbiting blades for sliding therein.

It is especially advantageous when the sealing means includes a labyrinth seal at least on a marginal portion of each of the orbiting blades that is remote from the power shaft. The sealing means may further include a channel system within at least each of the orbiting blades for supplying pressurized sealing fluid to the labyrinth seal.

A particular advantage of the present invention is that the construction proposed here renders it possible very effectively to eliminate mechanical friction between the rotating component and the stator housing. This friction elimination is primarily based on the possibility of providing the aforementioned remote marginal portions of the orbiting blades with the labyrinth seals; this possibility, in turn, is based on the constant radial dimension of each of the orbiting blades as it turns in the internal chamber about the central axis while being supported by respective bearing eyelets on the power shaft without being rigidly connected with it. The mounting of the orbiting blades on the power shaft by the respective eyelet pairs eliminates any tilting moment that could otherwise exist and makes possible operation at, for all intents and purposes, unlimited high r.p.m. speeds, without deleterious consequences that would otherwise arise from the action of centrifugal forces and resulting pressing of the blades against the stator housing surface bounding the internal chamber. This advantageous construction of the rotary machine makes it possible to use this rotary machine even in conditions calling for very high rotational speeds.

Another advantage of this construction resides in the accommodation of the axial end portions of the rotor in the end walls of the stator housing that bound the internal chamber; this makes it possible to provide even these zones of the orbiting blades with contactless labyrinth seals or seals exhibiting similar properties, which assures a highly effective suppression of pressure gradients at the regions in question and makes it possible to construct the machines of this type with a relatively small axial length but a relatively sizable diameter. As a result, this construction makes it possible to use the rotary machine for high power parameters and transmission of relatively high torques in the applications of such rotary machines not only in compressor units but also, and especially, in expansion motor units. The transmission of the torque between the power shaft and the rotor proper by means of the aforementioned auxiliary gear train assures uniform movement of the central power shaft without pulsation or oscillation. Last but not least, the structure of the rotary machine embodying the present invention makes it possible to provide a thermal machine operating on the basis of Brayton cycle with closed circulation of gas and with its external heating in the field of volumetrically operating machines, for instance in a combination of a compressor with an expansion motor. Such a combination of systems exhibits very advantageous ecological values as far as the exhaust gases are concerned, and the equipment is capable of operating at high efficiency ratios.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
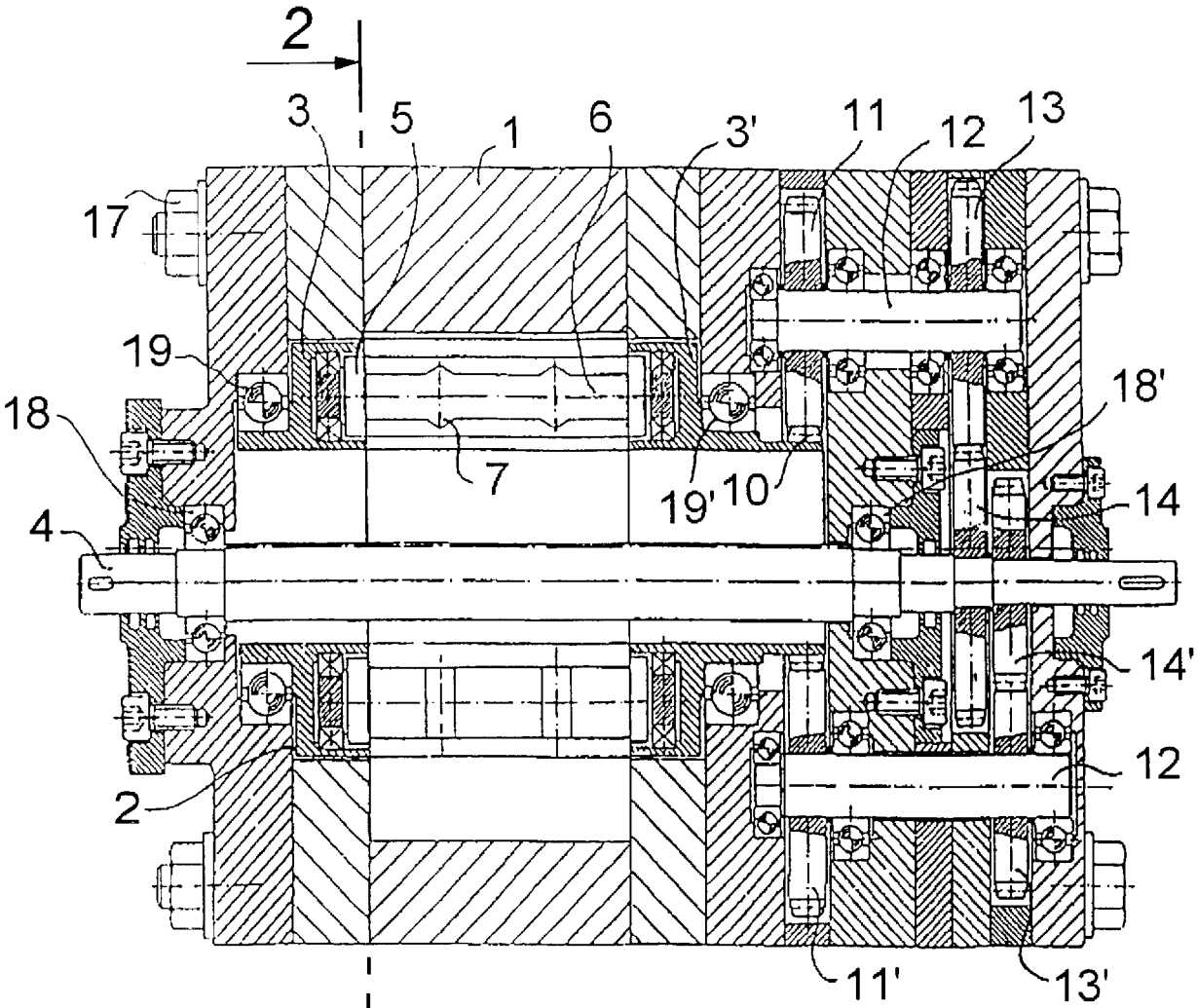
FIG. 1 is a longitudinal sectional view of an embodiment of the present invention in a rotary machine, taken generally along the line 1—1 of FIG. 2 but that guide element which is situated in the upper part of the machine being turned through about 90° out of its operating position shown in FIG. 2 for improved visualization of certain structural features thereof.

Referring now to the drawing in detail, and first to FIG. 1 thereof, it may be seen that the reference numeral 1 has been used therein to identify a housing of a rotary engine constructed in accordance with the present invention. It is to be mentioned at the outset that certain expedients of conventional nature that are being used in conjunction with, but do not constitute a critical features of, the invention, be they actual parts or respective recesses, bores or other similar voids, while being shown in the drawing, are not specifically identified in order not to unnecessarily clutter the drawing with reference numerals and corresponding lead lines. So, for instance, in the illustrated construction, the housing or stator 1 includes a plurality of juxtaposed, substantially parallel plate-shaped constituent parts situated between two end plates, the entire stator assembly being interconnected, for instance clamped together by respective bolts 17. In this context, it is to be stated that this particular configuration of the housing 1 is exemplary only and it could, for instance, consist of a number of constituent parts that would be lower or higher than what is shown; this is also true with respect to other parts of the machine. The aforementioned stator parts collectively bound an internal space of the housing 1 that includes a substantially circularly cylindrical internal working chamber 2. Furthermore, reference may be had here to the fact that, for facilitating the understanding of the disclosure, respective parts that correspond to and functionally complement each other but are spaced from one another, such as axially, being located at opposite axial ends of the housing 1, will be distinguished from each other by the presence or absence of a prime, respectively.

Bearing that in mind, it may be seen that respective bearings 18 and 18' support a central shaft 4 on the stator housing 1 for rotation about a central axis of the aforementioned working chamber 2. Depending on whether the rotary machine is being used as a power consumer (e.g. a compressor) or a power supplier (e.g. a fluid expansion motor), the central shaft 4 transmits input or output power in the form of torque, and consequently will be referred to at least occasionally as a power shaft. Each of a pair of carrier rings 3 and 3' is supported on the housing 1 for rotation about another axis that is parallel to but transversely offset from (i.e. eccentric with respect to) the axis of the central shaft 4, by a respective associated one of a pair of bearings 19 and 19' that are situated and supported on the housing 1 at respective wall portions of the latter that axially delimit the internal chamber 2. The carrier rings 3 and 3' are provided, at their axial surfaces that face each other, with respective (unidentified) mutually aligned recesses or bores in which there are supported, for at least limited turning about respective axes extending parallel to the aforementioned central axis of the working chamber 2 and power shaft 4, respective cylindrical blade guiding members 5. The purpose of these guiding members 5 is to guide respective associated blades 8. To this end, each of these guiding members 5, the number of which corresponds to that of the blades 8, is provided with a respective axially and radially extending slot or through passage 6 that may be seen particularly well in the upper part of FIG. 1, where the respective guiding member 5 has been turned through about 90° out of its normal operating position. It may also be seen there that respective substantially prismatic guiding recesses 7 are present in opposite walls bounding the passage 6. As shown for instance in FIG. 4 of the drawing, the wings 8 have respective substantially prismatic guiding protuberances 7'; these are received in and guided for sliding movement by the aforementioned guiding recesses 7 when the blades 8 and the cylindrical guiding members 5 assume their assembled, operational positions relative to one another.

A delimiting and/or separating bar 9 is disposed between each two circumferentially adjacent ones of the guiding members 6. The ends of each of these separating bars 9 are rigidly connected with the carrier rings 3 and 3', respectively. At least one of the carrier rings 3 and 3' (as shown, the right one designated as 3') is equipped with an annular crown gear 10 that permanently meshes with a corresponding first auxiliary spur gear 11. The first auxiliary spur gear 11 is secured to an auxiliary shaft 12 mounted in the internal space of the housing 1 for rotation about its axis, and a second auxiliary spur gear 13 is secured to the auxiliary shaft 12 at an axial distance from the first auxiliary spur gear 11 for rotation in unison with the auxiliary shaft 12 and with the first auxiliary spur gear 11 about the axis of the auxiliary shaft 12. The second auxiliary spur gear 13 is in a permanent meshing relationship with a central spur gear 14 that is mounted on and secured to the central shaft 4 for joint rotation therewith. The parts 11 to 14 thus form an auxiliary gear transmission train between the crown gear 10 and the central shaft 4.

FIG. 1 further shows that the exemplary embodiment of the machine of the present invention shown there further includes an additional auxiliary transmission train 11' to 14' structurally and functionally, yet not dimensionally or positionally, similar to the train 11 to 14. Here again, an additional first auxiliary spur gear 11' is secured to an additional auxiliary shaft 12' mounted in the internal space of the housing 1 for rotation about its axis and permanently meshes with the crown gear 10, while an additional second auxiliary spur gear 13' is secured to the additional auxiliary shaft 12 at an axial distance from the additional first auxiliary spur gear 11' for rotation in unison with the additional auxiliary shaft 12' and with the additional first auxiliary spur gear 11' about the axis of the auxiliary shaft 12'. The additional second auxiliary spur gear 13' is in a permanent meshing relationship with an additional central spur gear 14' that is mounted on and secured to the central shaft 4 for joint rotation with it. The transmission train 11' to 14' is shown to be situated at a mirror-symmetrically disposed location relative to the train 11 to 14, and may be so located in reality as well, even though the section line 1—1 of FIG. 2 appears to indicate otherwise. This mirror-symmetrical arrangement of the two gear trains 11 to 14 and 11' to 14', respectively, is being used to advantage in accordance with the invention to achieve an improved torque transmission between the rotor 3 to 9 and the central power shaft 4 while simultaneously avoiding imposition of unilateral transverse loads on the shaft 4. However, the gear trains 11 to 14 and 11' to 14' could also be offset from each other by an angle different from 180° about the axis of the central shaft 4, and/or one or more other gear trains similar thereto could be interposed between them, as needed or preferred to improve central shaft load distribution. It is also possible and proposed by the present invention, albeit not shown in the drawing, to transmit torque between the carrier ring 3 and the central shaft 4 as well, in the same fashion as discussed just above, by providing the carrier ring 3 with its own crown gear and interposing further gear trains like those discussed above between this further crown gear and the shaft 10 to the left of the rotor.

Figure 2:
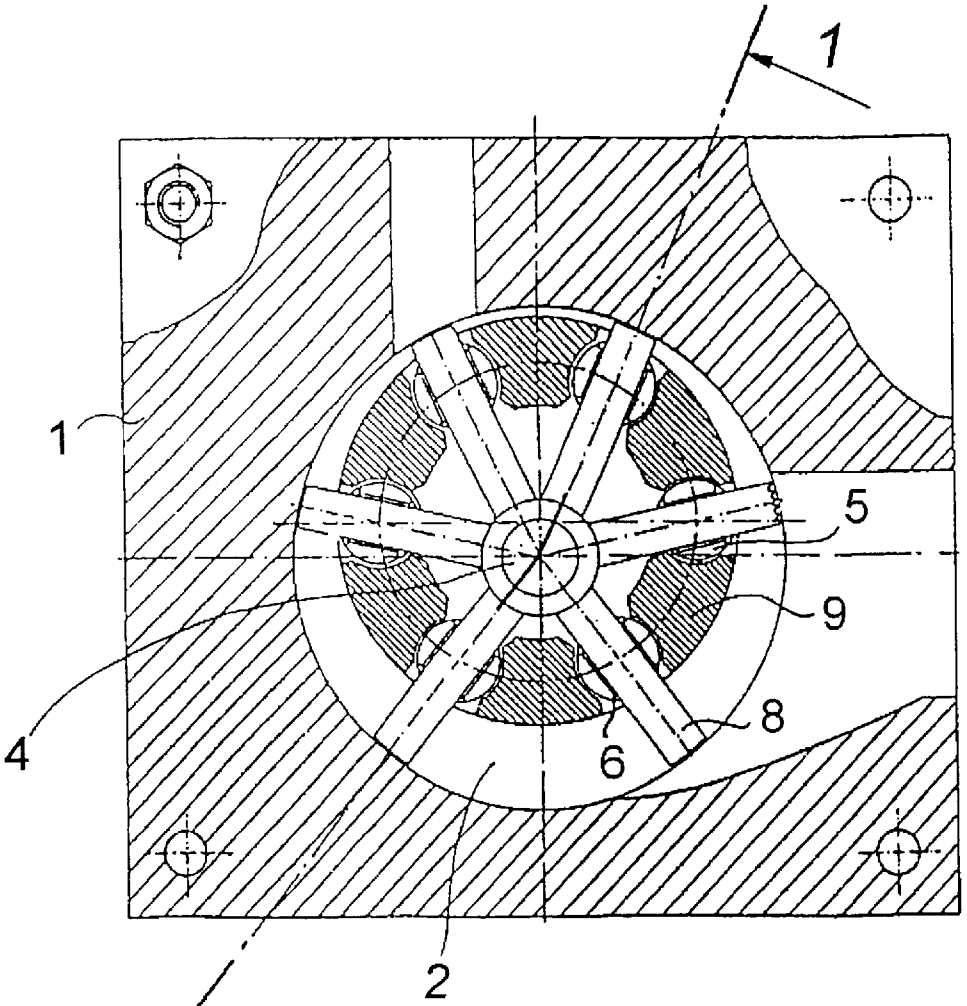
FIG. 2 is a cross-sectional view through the rotary machine of the invention, taken on line 2—2 of FIG. 1.

FIG. 2 of the drawing shows, in a cross-sectional view, the circularly cylindrical internal chamber 2 of the stator housing 1, as well as the distribution of the orbiting blades 8 that are supported on the central shaft 4 but not rigidly connected therewith. The individual blades 8 are received and, as already mentioned before, slidingly guided in the respective slots 6 of the associated cylindrical guiding members 5. FIG. 2 also shows, in cross sections, the respective separating bars 9 that, as explained before, are secured at their respective ends to the carrier rings 3 and 3' which, however, are obscured in FIG. 2. The surfaces of the separating bars 9 that face the respective guiding members 5 are concave and part-cylindrical in substantial conformity with and of the same radius as the corresponding surfaces of the cylindrical guiding members 5.

Figure 3:
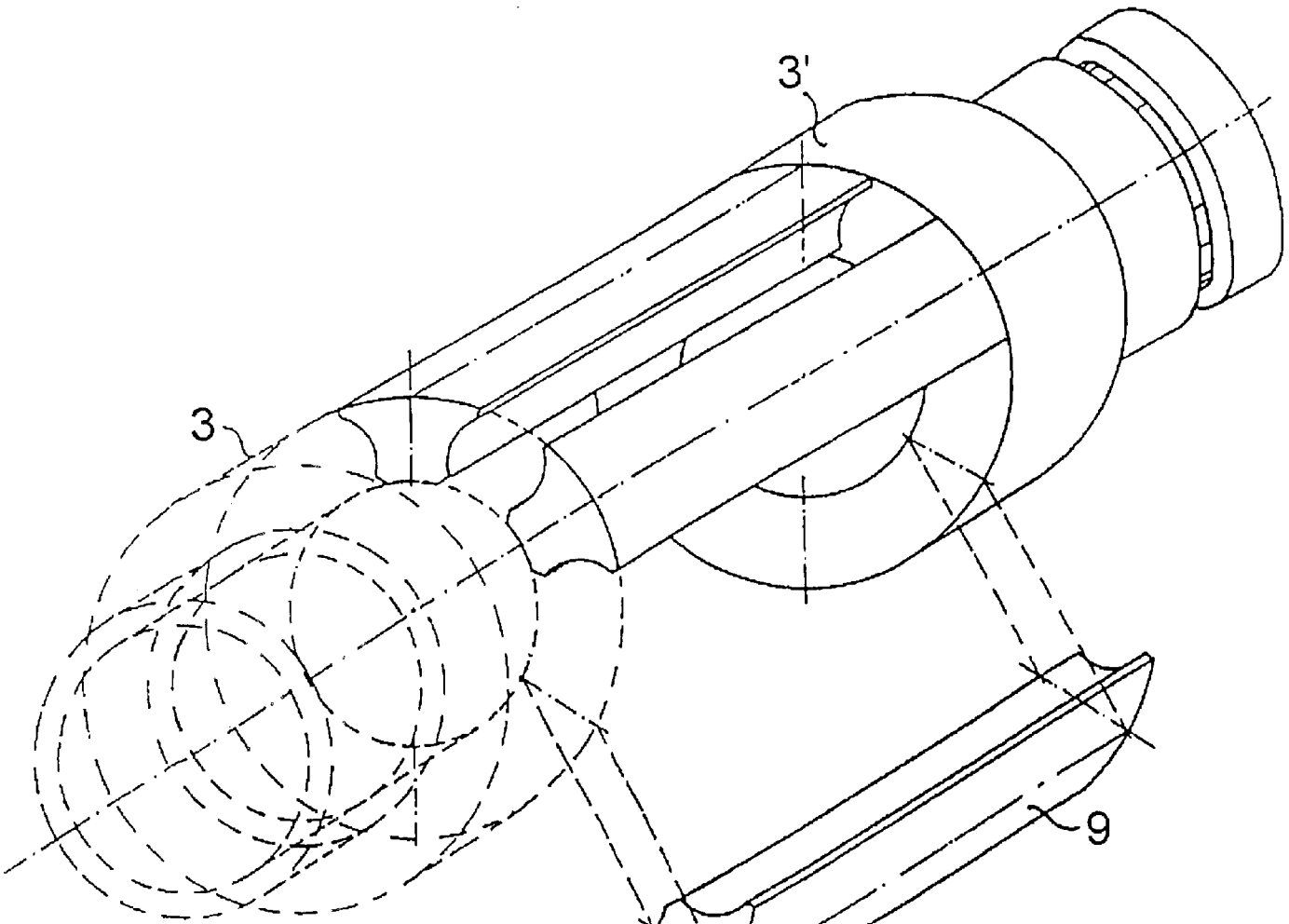
FIG. 3 is a partially exploded perspective view of a rotor of the rotary machine of FIGS. 1 and 2, with certain parts thereof shown merely in broken lines in order not to obscure other parts.

FIG. 3 depicts, in a perspective view, only the eccentric rotor part of the rotary machine of the present invention and the relative positions of its basic constituent parts. Particularly visible and specifically identified in FIG. 3 are the two carrier rings 3 (in broken lines) and 3', as well as the separating bars 9 one of which is illustrated, for better elucidation, in a position that is transversely displaced from that in which it is mounted when in use.

Figure 4:
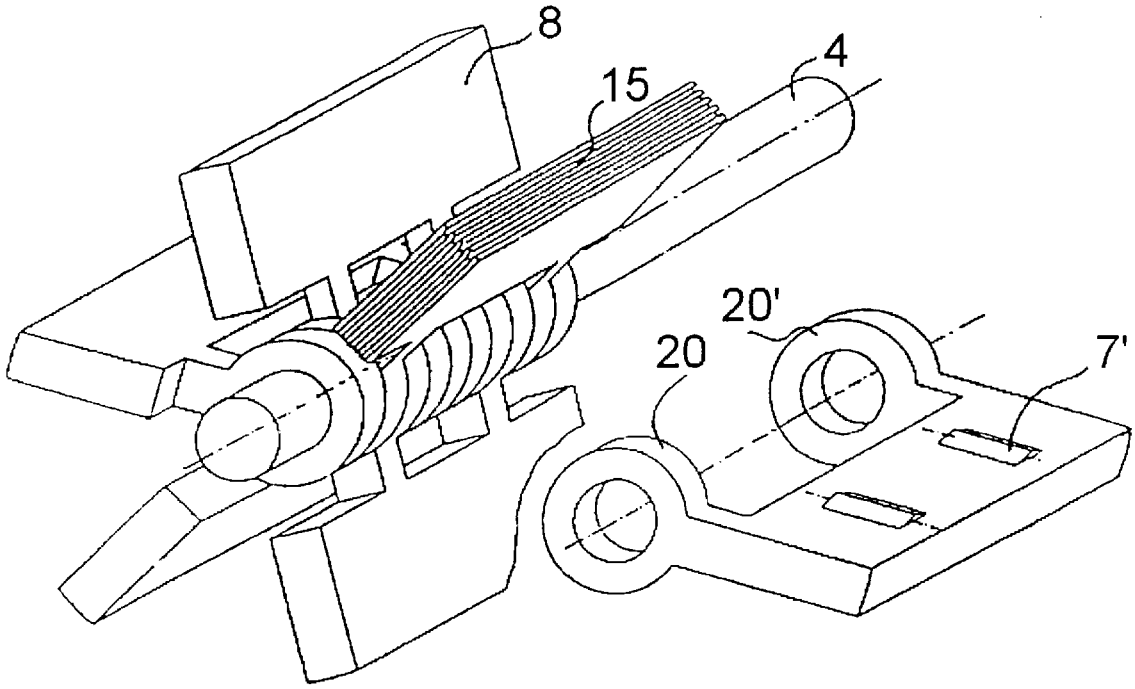
FIG. 4 is a view akin to that of FIG. 3 but showing a central shaft of the rotary machine and respective orbiting blades for the most part already assembled therewith.

FIG. 4 illustrates the pivotable mounting of the individual orbiting blades 8 on the central shaft 4 by means of, in each instance, a pair of symmetrically arranged bearing eyelets 20 and 20'. For better illustration, one of the orbiting blades 8 is removed from the central shaft 4 and shown separately, inclusive of the prismatic guiding protuberances 7' formed thereon, as well as the bearing eyelets 20 and 20'. On another one of the blades 8, there is shown a contactless labyrinth seal 15 shown to extend both along the outer axially extending marginal portion and the visible radially extending marginal portion.

Figure 5:
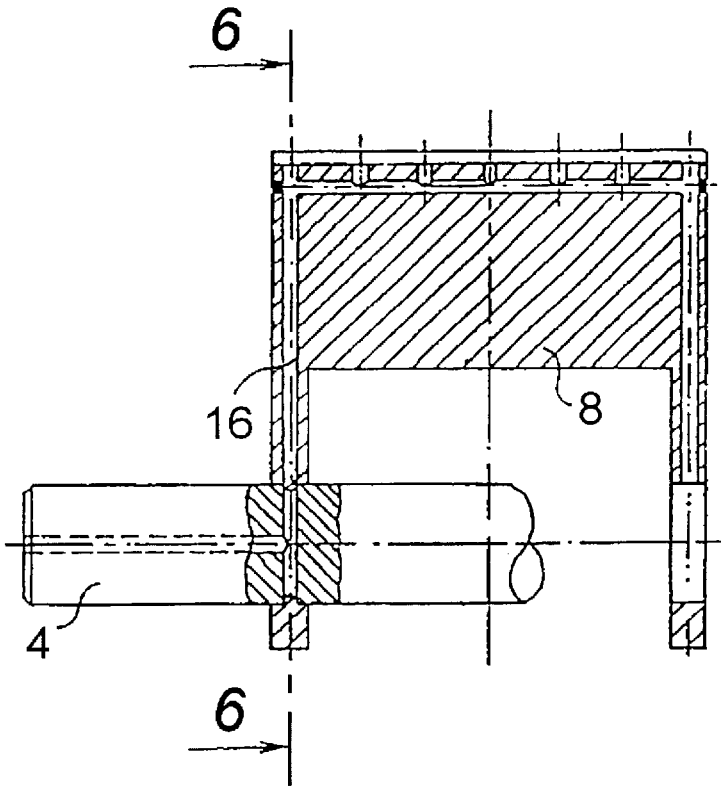
FIG. 5 is a partially sectioned side elevational view a portion of the central shaft with one of the orbiting blades mounted on this shaft portion in its ultimate operating position being shown in a sectional view taken on line 5—5 of FIG. 6.
Figure 6:
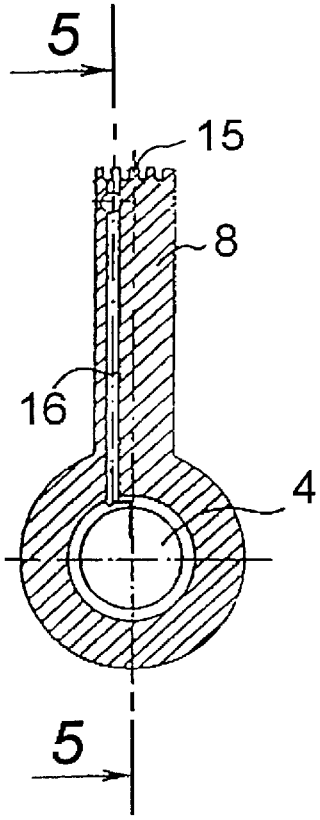
FIG. 6 is a cross-sectional view taken on the line 6—6 of FIG. 5.

Pressurized sealing fluid may be supplied to the labyrinth seal 15 through a system of channels 16 provided in the respective orbiting blade 8 and communicating with a corresponding channel system provided in the central shaft 4, as shown in partial longitudinal section in FIG. 5 of the drawing. This channel systems 16 serves, in some applications, among others, the purpose of achieving a separating effect at the affected regions between the individual adjacent compartments of the rotary machine. Another view of this channel system 16 is presented in a transverse section in FIG. 6 of the drawing, in which it may be seen that the pressurized sealing fluid channel system 16 of the respective orbiting blade 8 opens, at its end remote from the central shaft 4, into the contactless labyrinth seal 15.

Figure 7:
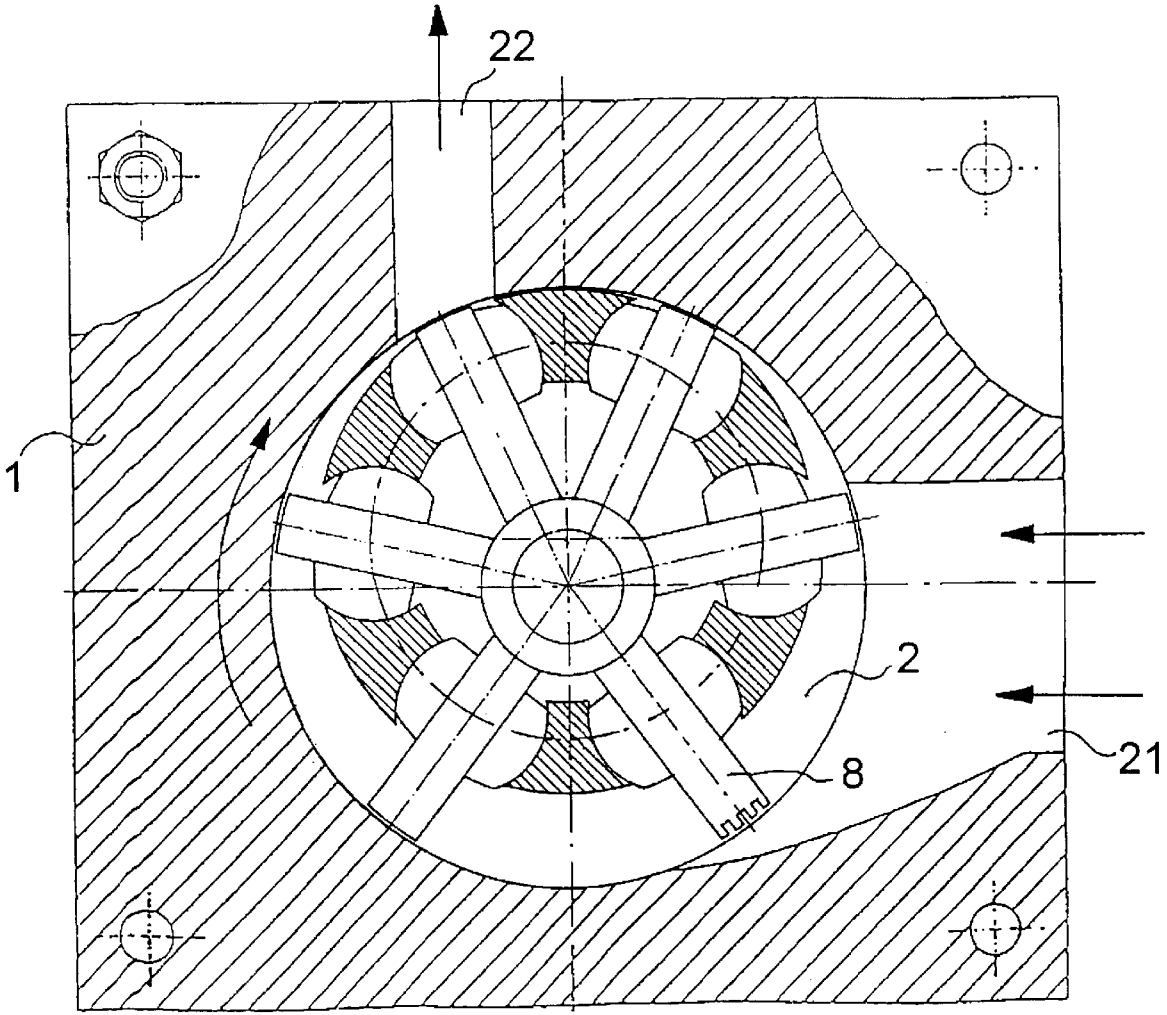
FIG. 7 is a cross-sectional view corresponding to that of FIG. 2 but indicating the features of the rotary machine when configured and used as a compressor.

FIG. 7 of the drawing shows the implementation of the rotary machine of the present invention for use as a compressor. It may be seen that an inlet channel 21 for the fluid to be compressed and an outlet channel 22 for the compressed fluid are present in the stator housing 1. An arrow indicates the sense of rotation of the rotating parts while the rotary machine is being as a compressor. Similarly, in FIG. 8 of the drawing, there is shown a rotary machine of the present invention, but this time for use as a fluid expansion motor. Herein, the reference numerals 23 and 24 indicate an inlet channel or port provided in the stator housing 1 for the admission of the energizing fluid and an outlet, discharge or exhaust channel or port for the spent fluid. Also shown, by an arrow, is the sense or rotation of the rotor components, and a relief channel 25 for the remaining spent fluid.

When the rotary machine of the present invention is constructed as shown in FIG. 7 of the drawing to operate as a compressor, the medium to be compressed is admitted through the inlet channel 21 into the adjacent region of the cylindrical internal chamber 2 of the stator housing 1, where it is entrained for joint travel in the direction indicated by the arrow by the respective orbiting blades 8; then, the combined effect of the eccentrically mounted rotor assembly and of the movement of the two blades 8 bounding the respective compartment toward each other is a reduction in the volume of the compartment in question, resulting in compression of the medium contained in that compartment. As the affected compartment continues to move in the same sense, its volume gradually diminishes further and the medium contained therein is both compressed more and advanced in the aforementioned sense until the compartment opens into the outlet channel 22 of the compressor and the now fully compressed medium is discharged into the channel 22. After that, the circumferentially adjacent blades 8 commence to move apart and the volume of the respective compartment starts to increase again, until the entire process is repeated when the affected blades 8 have completed one full orbit bout the central shaft 4. The operating effect of the orbiting blades 8 can be adjusted, in conjunction with the alternatively increasing and decreasing volumes or sizes of the compartments situated between the adjacent blades 8, by appropriately selecting the number of the orbiting blades 8, the eccentricity of the eccentric rotor component, the thickness of each individual blade 8, the location and the flow-through cross sections of the inlet channel 21 and of the outlet channel 22, and the axial length of the rotating part of the machine.

Figure 8:
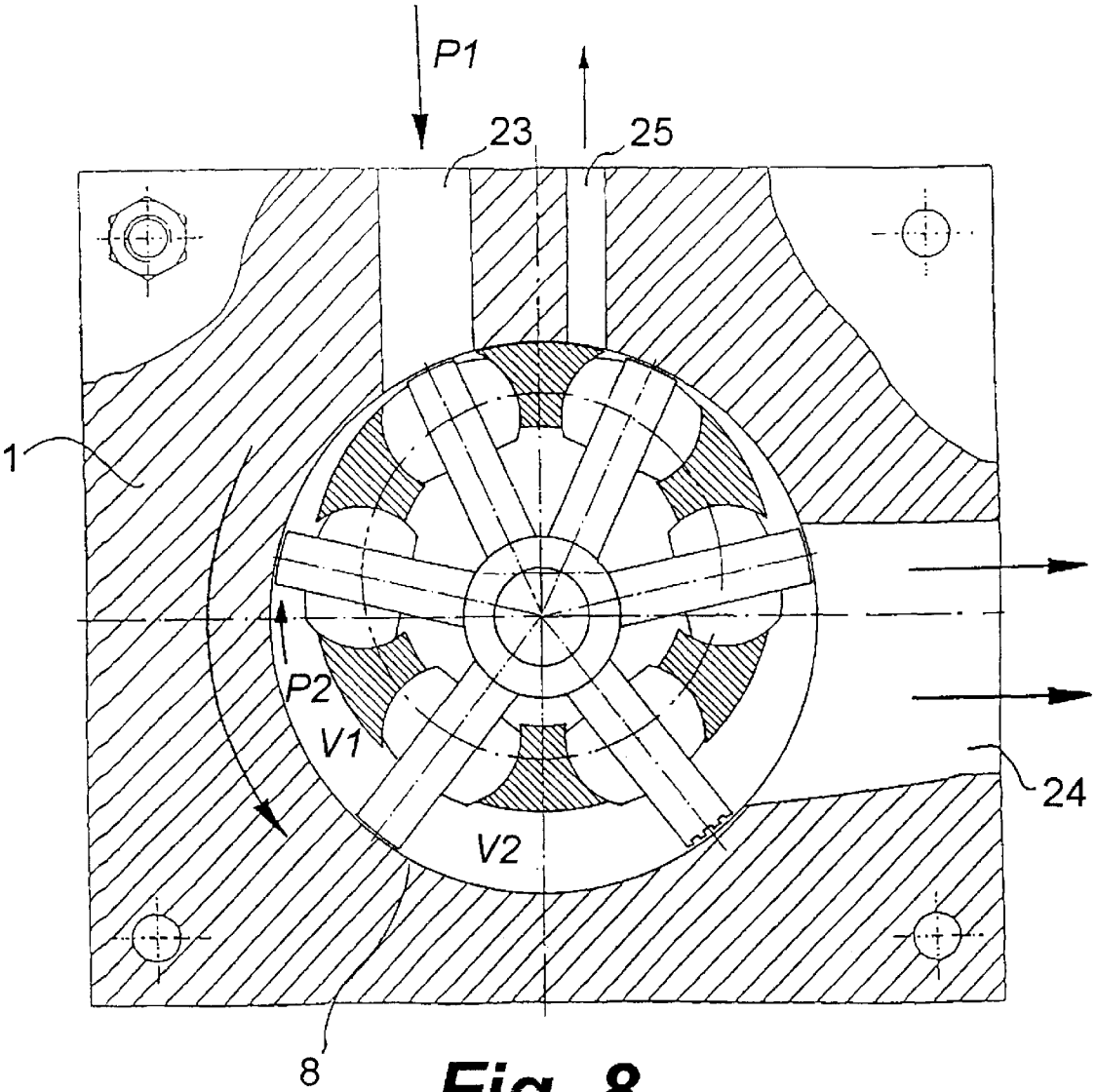
FIG. 8 is a cross-sectional view that again corresponds to that of FIG. 2 but this time constructed for use as an expansion motor.

When the rotary machine is constructed as shown in FIG. 8 of the drawing for use as an expansion motor, an energizing medium, for instance compressed air, is delivered, at a pressure P1, into the respective compartment which at that time is open toward the inlet channel or port 23. This pressure P1 then acts on a surface S of the respective orbiting blade 8. In the preceding compartment V1 as considered in the direction of rotation, there is present an already partially expanded medium, at a pressure P2. Hence, the pressure P1 acting on the blade 8 separating these two compartments is counteracted and hence in effect reduced by the pressure P2, so that the resulting pressure ΔP acting on one of the orbiting blades 8 delimiting the then closed compartment V1 in the rotational sense indicated by the arrow is $\Delta P = P1 - P2$. The force acting in the sense of rotation is expressed by the product $F = \Delta P \cdot S$, and it acts on a radius R of the effective moment arm of the blade 8, thus creating a turning moment or torque MT represented by the equation $$MT = R \cdot \Delta P \cdot S = R \cdot F.$$

If more than one of the orbiting blades 8 is present between the input channel 23 for the pressurized medium and the exhaust channel 24 for the expended medium, then the overall torque is the sum of the partial torques.

The expansion motor thus works during the first phase or its operation as a full-pressure motor; after the compartment V1 is filled with the pressurized medium and separated from the inlet channel 23 by the advancing blade 23, expansion of the medium takes place in the compartment V1 until it reaches the volume of the next preceding chamber V2 which is shown to be in a position shortly before establishment of its communication with the exhaust channel 24. The medium remaining in the respective compartment after moving beyond the discharge channel 24 is discharged through the additional discharge or relief channel 25, after which the entire process is repeated.

It will be understood that each of the elements described above, or two or more together, may also find a useful application in other types of constructions differing from the type described above.

While the present invention has been described and illustrated herein as embodied in specific construction of rotary machines to be used as compressors or expansion motors, it is not limited to the details of these particular constructions, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

What is claimed is:

1. An orbiting blade rotary machine, especially for use in compressor and expansion motor units, comprising a stator housing bounding an internal space that includes a substantially cylindrical internal chamber centered on a central axis; a power shaft extending in a centered relationship along said central axis through said internal space inclusive of said working chamber thereof and mounted on said stator housing for rotation about said central axis; a plurality of orbiting blades each supported on said power shaft for rotation about said central axis independently of said power shaft and always extending substantially radially outwardly from said power shaft in said internal chamber toward said stator housing; an eccentric rotor mounted in said stator housing for rotation about an eccentric axis parallel to and transversely offset from said central axis and accommodated in said internal chamber to delimit a working space therein that said orbiting blades subdivide into individual compartments and including means for guiding said orbiting blades for sliding relative to said eccentric rotor; a gear transmission between said power shaft and said eccentric rotor including a spur gear secured to said power shaft, a spur gear secured to said eccentric rotor, and auxiliary gears connecting said spur gears; and means for sealing the interfaces between said orbiting blades and said stator housing.

2. The rotary machine as defined in claim 1, wherein said eccentric rotor includes a pair of axially spaced carrier rings and a plurality of connecting bars interconnecting said carrier rings in substantial parallelism with said eccentric axis and including substantially part-circular cylindrical surfaces facing each other; and wherein said guiding means includes a plurality of guiding cylinders, one for each of said orbiting blades, each accommodated in sealed relationship between said surfaces of said connecting bars for turning relative thereto and each including an axially and radially extending passage for receiving the respective one of said orbiting blades for sliding therein.

3. The rotary machine as defined in claim 1, wherein said sealing means includes a labyrinth seal at least on a marginal portion of each of said orbiting blades that is remote from said power shaft.

4. The rotary machine as defined in claim 3, wherein said sealing means further includes a channel system within at least each of said orbiting blades for supplying pressurized sealing fluid to said labyrinth seal.

* * * * *